US007699679B2

(12) United States Patent
Lahyani

(10) Patent No.: US 7,699,679 B2
(45) Date of Patent: Apr. 20, 2010

(54) INFLATABLE LIFE-SAVING SWIMMING GARMENT

(75) Inventor: Iris Lahyani, Beer-Sheva (IL)

(73) Assignee: Sosmart Rescue Ltd., Netivot (IL)

( * ) Notice: Subject to any disclaimer, the term of this patent is extended or adjusted under 35 U.S.C. 154(b) by 0 days.

(21) Appl. No.: 11/876,932

(22) Filed: Oct. 23, 2007

(65) Prior Publication Data

US 2008/0268731 A1 Oct. 30, 2008

(30) Foreign Application Priority Data

Feb. 25, 2007 (IL) ..... 181533

(51) Int. Cl.
*B63C 9/125* (2006.01)

(52) U.S. Cl. ..... 441/90; 441/89; 441/96; 441/106

(58) Field of Classification Search ..... 441/90, 441/91, 92, 93, 94, 96, 102, 106, 111, 89; 405/185, 186, 187, 193; 606/201, 202
See application file for complete search history.

(56) References Cited

U.S. PATENT DOCUMENTS

| | | | | |
|---|---|---|---|---|
| 1,752,120 | A | 3/1930 | Taylor | |
| 2,571,532 | A | 10/1951 | Briscoe | |
| 3,638,258 | A * | 2/1972 | Black | 441/92 |
| 4,968,277 | A * | 11/1990 | Parish et al. | 441/93 |
| 5,500,952 | A * | 3/1996 | Keyes | 441/93 |
| 6,106,348 | A * | 8/2000 | Loisel | 441/92 |
| 6,962,599 | B2 * | 11/2005 | Hui | 606/202 |
| 6,976,894 | B1 | 12/2005 | Turner | |
| 7,017,195 | B2 * | 3/2006 | Buckman et al. | 2/455 |

FOREIGN PATENT DOCUMENTS

| | | |
|---|---|---|
| JP | 2241890 | 9/1990 |
| WO | WO 97/09556 | 3/1997 |
| WO | WO 2007/038794 A3 | 4/2007 |

OTHER PUBLICATIONS

Brocher of Guide-On Technology Ltd.; http://www.technion.ac.il/technion/dimotech/guide.html#contact.
Israel Venture Capital Research Center; http://www.ivc-online.com/G_info.asp?objectType=l&fObjectID=3788&CameFrom=GoogleSearch.

* cited by examiner

*Primary Examiner*—Lars A Olson
(74) *Attorney, Agent, or Firm*—Merchant & Gould P.C.

(57) ABSTRACT

An inflatable life-saving swimming garment for a swimmer that comprises an inflatable part for floating the swimmer while being in distress and for creating, when inflated, volume difference between upper body part and lower body part of the swimmer. The garment includes an inflating system that consists of a gas tank with compressed gas for inflating, whenever required, the inflatable part; a controllable valve connecting between the air tank and the inflatable part, for allowing, whenever required, the compressed gas to inflate the inflatable part; a controller for analyzing the swimmer's status underwater and opening the valve after the swimmer has been in an actual or impending distress for a predetermined time; and a battery for supplying power for the operation of the controller and the valve.

12 Claims, 7 Drawing Sheets

INFLATABLE LIFE-SAVING SWIMMING GARMENT

FIELD OF THE INVENTION

The present invention relates to an inflatable life saving apparatus. The invention particularly relates to an inflatable life-saving swimming garment for children and toddlers, and which is operable automatically or manually in distress and emergency situations.

BACKGROUND OF THE INVENTION

Life-saving swimming garments are designed to decrease the number of drowning cases amongst children while swimming in the open sea or in swimming-pools. Swimming in the open sea requires overcoming safety problems, such as powerful drift currents and swirls, which are risky even for a skilled swimmer.

During the swimming season, swimming areas in the sea and swimming-pools are enormously crowded, and therefore, the ability of lifeguards to notice an emergency situation is limited, particularly in case of a drowning child who is not a skilled swimmer. It requires only a few seconds for a small child to disappear underwater without any attention paid by the adults in the vicinity, and especially the attention of the lifeguard who has to notice any exceptional or emergency situation. Also, toddlers, who have been left unsupervised in a bath for few moments, can lose their balance, while sitting, and drown, even though it is very shallow water.

Several approaches to overcome drowning problems use buoyant clothing, e.g., inflatable arm bands, annular flotation members, etc. All these inflatable devices generally limit the mobility of a young swimmer so that he cannot enjoy the swimming activity. Therefore, inflatable devices are usually not worn by the children who have developed some swimming skills.

Those swimming skills are often not sufficient to function in panic situations or at momentary lapsing of the swimmer's capabilities. Moreover, in most cases, toddlers or babies take off the inflatable device or refuse to put it on.

JP 2,241,890 discloses a floating device for rescuing a drowning person. The floating device is a necklace-shaped float tube that fits, before inflation, onto the neck of the swimmer. The necklace-shaped float tube is attached to a miniature sealed sack by means of an air pipe. The sealed sack contains miniature timer, an electronic circuit and an air bottle. The air bottle comprises a valve which is located in the air bottle stopper. The valve is connected to the electronic circuit which is attached to the miniature timer by wiring. A water-sensor that floats on the water surface is connected to the electronic circuit, by a wire. When the swimmer is drowning, the water-sensor wire is forced against the water-sensor which is sunk down and activates the miniature timer. The miniature timer is adjusted by the swimmer to a threshold underwater time. When the threshold time lapses, a signal is sent to the electrical circuit which, in turn, sends a command to the valve to open. After the valve is opened, the air from the bottle flows to the float tube through the air pipe, and inflates it. Thus, the inflated float tube floats to the swimmer up above the water surface level for breathing. However, there are some drawbacks associated with this device. When a child is playing in the sea or in a swimming-pool where the water is shallow, the danger of drowning still exists. In this case, the floating/rescuing device may be useless when a child is lying unconscious at the bottom of shallow swimming-pool or sea. The floating device may not inflate because the water-sensor is not deep enough to create the appropriate force between the water-sensor and the sealed sack, which is needed to operate the miniature timer. On the other hand, a child who is a more skilled swimmer wants to dive more than a few centimeters below the water surface level without restrictive devices. Using the device described hereinabove, restricts the swimmer to stay close to the water surface level. Thus, false alarms may be caused.

An additional drawback of such devices is their arrangement/structure. Swimming or paddling within an aquatic environment should be safe and comfortable feeling This floating device, when inflated, may apply pressure on the neck and may cause blood flow and breathing problems. Furthermore, the device's components are attached to the float tube by an air pipe and a wire that hang freely from the neck, thereby interrupting swimming.

It is therefore an object of the present invention to provide an inflatable life-saving swimming garment for children and toddlers which overcomes the problems associated with the prior art.

It is a further object of the present invention to provide an inflatable life-saving swimming garment for children and toddlers which is operable automatically in an actual emergency situation.

It is yet another object of the present invention to provide an inflatable life-saving swimming garment for children, which is instantly operable when the child is in distress.

It is an additional object of the present invention to provide an inflatable life-saving swimming garment for children and toddlers which floats them up with the head directed upward.

It is another advantage of the present invention to provide an inflatable life-saving swimming garment for children and toddlers that is reliable.

Additional objects and advantages of the present invention shall become clear as the description proceeds.

SUMMARY OF THE INVENTION

The present invention is directed to an inflatable life-saving swimming garment for a swimmer, that comprises:

- an inflatable part preferably with separated inflatable sections, for floating the swimmer while being in distress and for creating, when inflated, volume difference between upper body part and lower body part of the swimmer, so as to raise the swimmer up with his head directs to the water surface level;
- an inflating system that includes:
  - a gas tank with compressed gas which is not inflammable, such as air or CO2 for inflating, whenever required, the inflatable part;
  - an electronically controllable valve, connecting between the air tank and the inflatable part, for allowing, whenever required, the compressed gas to inflate the inflatable part;
  - a controller for analyzing the swimmer's status underwater and opening the valve after the swimmer has been in an actual or impending distress for a predetermined time; and
  - a battery for supplying power for the operation of the controller and the valve.

The inflatable part may be attached to the swimming garment by gluing or sewing.

The inflatable life-saving swimming garment may be suitable to fit the swimmer's size. The inflatable part and the inflation system may be worn on an exposed upper body, without the swimming garment. The inflatable part may be connected to the gas tank directly by a valve or indirectly, via a valve and an air pipe. The separated inflatable parts are inflated by one or more valves that branch out of the gas tank.

The gas tank may further include a pressure sensor for sensing the amount of gas remained. The inflating system may further comprise an additional valve that is manually operable by pulling a button loop that is connected to the additional valve by wiring.

The controller may comprise:

- electrical contacts for providing indication regarding salt-water and pool water;
- a depth-meter for measuring the present depth and a threshold depth;
- a digital-timer for measuring the time for being at, or deeper than, the threshold depth;
- an orientation sensor for sensing the deviation angle, such as a negative angle, from the vertical position, related to the water's surface level;
- a central processing unit (CPU) with software for analyzing the data inserted and received from the inflation system, for processing the data that is inserted and received;
- a memory card for saving data related to the swimmer;
- a threshold depth-meter display for displaying the depth remains before starting the digital timer;
- a digital-timer display for displaying the time remains before sending the signal to the electronically controlled valve to open;
- a depth display for displaying the current depth;
- a light button for illuminating the controller whenever desired;
- a digital-timer adjusting button for adjusting the threshold time;
- a depth-meter adjusting button for adjusting the threshold depth;
- a self-test button for testing the inflation system;
- a display for operability of the inflation system;
- a battery for supplying electrical energy to the inflation system; and
- a battery status display for displaying the current status of the battery.

The depth-meter is adjusted to threshold depth and the digital timer is adjusted to threshold time. Whenever the inflatable life-saving swimming garment is at, or deeper than, the threshold depth, the CPU sends a signal to the digital timer to start count down. Whenever the inflatable life-saving swimming garment is at the threshold depth and the threshold time lapses, the CPU sends a signal to the electronically controlled valve to open.

The inflatable life-saving swimming garment may further comprise a signaling system, connected to the controller, to signal a swimmer in distress. The signaling system preferably comprises:

- a balloon for signaling the swimmer;
- a tank with compressed lightweight connected to the controller for inflating the balloon; and
- a pipe with a valve such as an electronically controlled valve, for connecting the gas tank to the balloon;
- a LED within the balloon to emit light whenever required.

The pipe contains inside an electrical wire for conveying power to the LED from a battery or from the controller.

BRIEF DESCRIPTION OF THE DRAWINGS

All the above and other characteristics and advantages of the invention will be further understood through the following illustrative and non-limitative description of preferred embodiments thereof, with reference to the appended drawings.

In the drawings.

DETAILED DESCRIPTION OF PREFERRED EMBODIMENTS

The inflatable life-saving swimming garment proposed by the present invention comprises an inflatable part that is inflated using an inflation system, attached to it. For brevity, the term "inflatable life-saving swimming garment" and the term "swimming garment" will be used interchangeably in this application to describe the apparatus of the invention.

Figure 1:
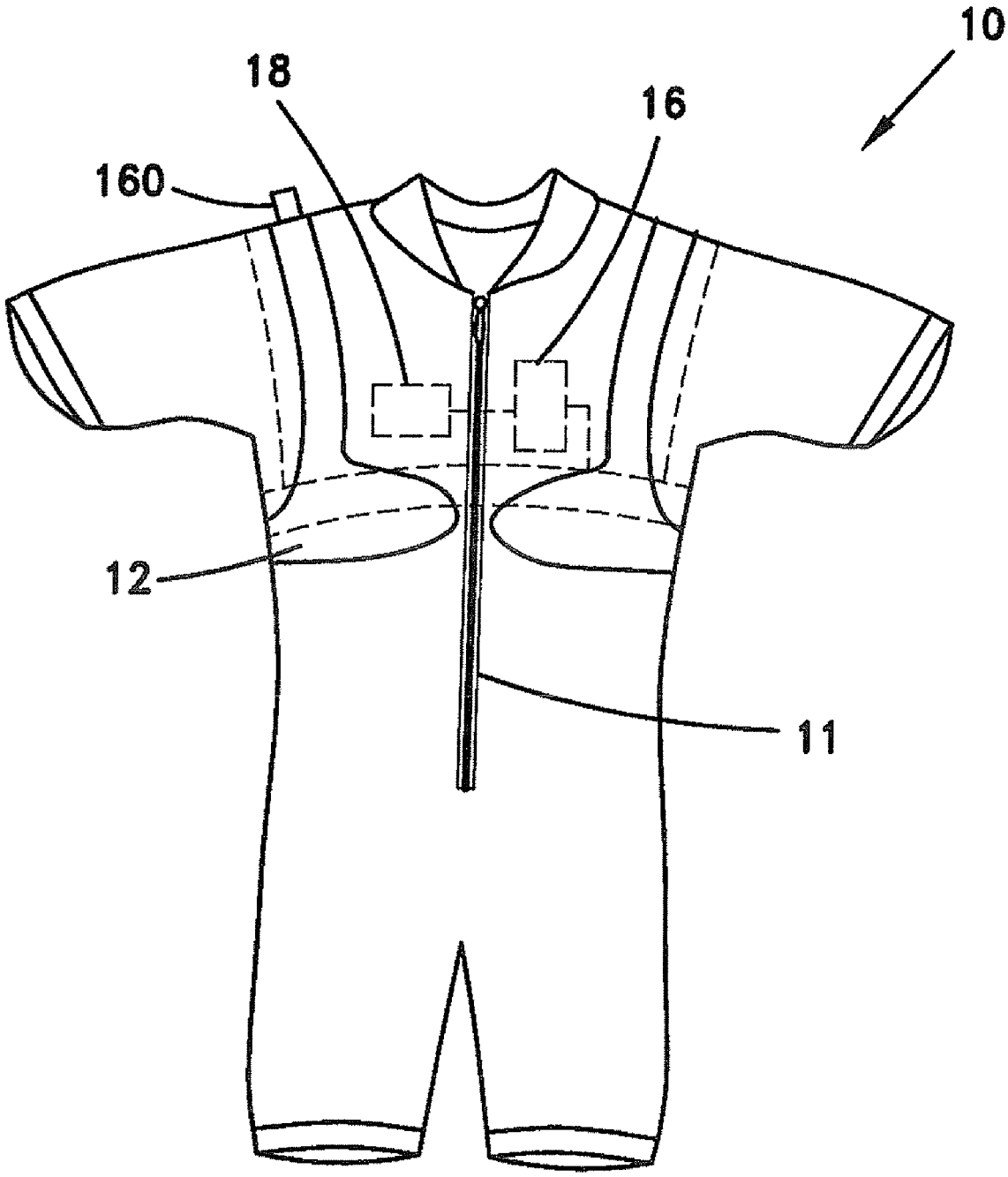
FIG. 1 is a schematic illustration of an inflatable life-saving swimming garment for children, according to a preferred embodiment of the present invention.

FIG. 1 is a schematic illustration of an inflatable life-saving swimming garment 10 for children. Swimming garment 10 includes a zipper 11 for easier dressing, and a concealed inflatable part 12 which is attached to the shoulders and waist regions of the garment 10 by any appropriate means. A small air tank 16 that contains compressed air is attached to the inflatable part 12 by an air pipe and an electronically controlled valve (not shown), which is controlled by controller 18.

Controller 18 is composed of a depth-meter and a digital-timer (not shown) that are synchronized. The depth-meter measures the water depth by sensing the underwater pressure and converts it into depth units. The depth meter, the digital-timer, and the valve are connected to controller 18 by wiring, and thus function as an integrated device.

Before the child enters the water with swimming garment 10, a self-test is done to verify that the equipment is intact. Afterward, a depth threshold and a time threshold are adjusted in the depth-meter and in the digital-timer, respectively. The depth threshold is adjusted in accordance with the child's body dimensions. Because of safety considerations, the minimum depth threshold should be the distance between the child's chin and his chest. The minimum time threshold should be adjusted by an adult.

As long as the child wears swimming garment 10 and swims at the water surface level, the depth reading received by the controller 18 is smaller than the adjusted depth threshold. If the child is submerged deeper than the depth threshold, an electronic signal from the depth-meter is sent to the digital-timer through controller 18. The digital-timer starts counting down toward the threshold time and continues, as long as the current depth is deeper or equal to the depth threshold.

When the threshold time has lapsed, an electronic signal is sent to controller 18 from the digital timer. Controller 18 processes the signal from the digital-timer and sends a command in the form of an electronic signal to open the electronically controlled valve. After the electronically controlled valve is opened, the compressed air within air tank 16 expands into inflatable part 12 through the air pipe and inflates it.

The upper body part of the child increases its volume in accordance with the volume of inflatable part 12, while the child's lower body part volume remains constant. Thus, the volume difference between the two body parts causes a torque which rotates the child body around its center of mass, i.e. the waist. The child's body rotates around its center of mass point until its longitudinal axis is perpendicular to the water surface level. Therefore, while the inflatable part 12 inflates, the child starts rising up with is head directed up to the water surface level until he floats above it. The upper part of the child's body is always directed up first, even when, initially, the child's head is directed down towards the see/swimming-pool bottom.

Figure 2B:
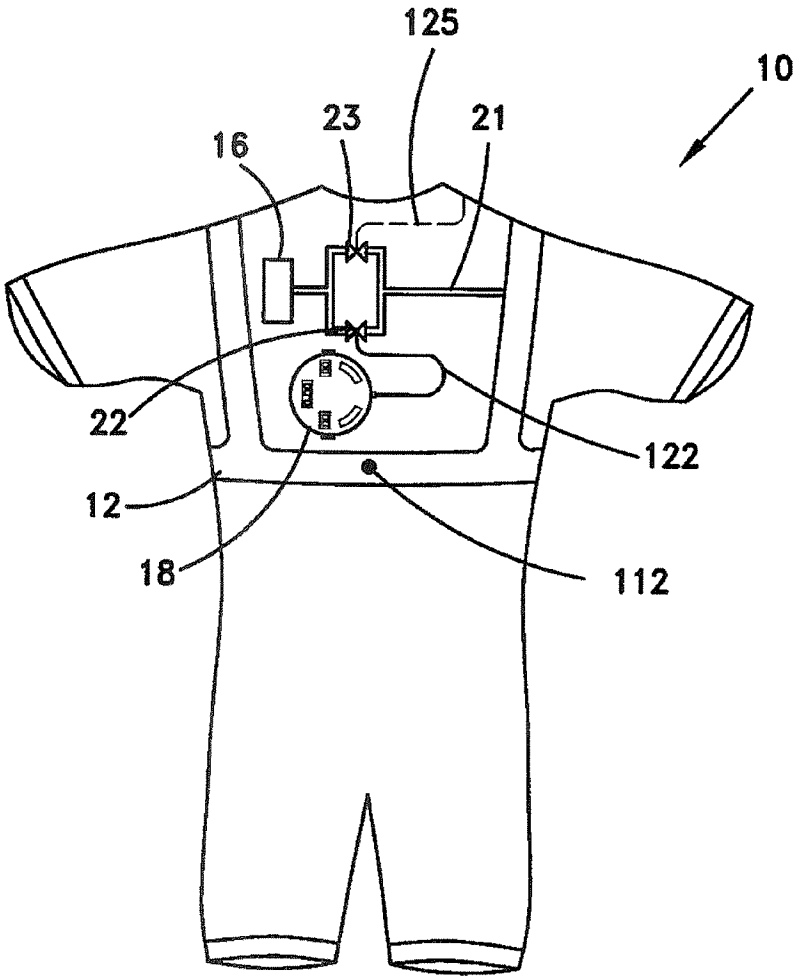
FIG. 2*b* is a rear view of the inflatable life-saving swimming garment for children, according to a preferred embodiment of the present invention.
Figure 2A:
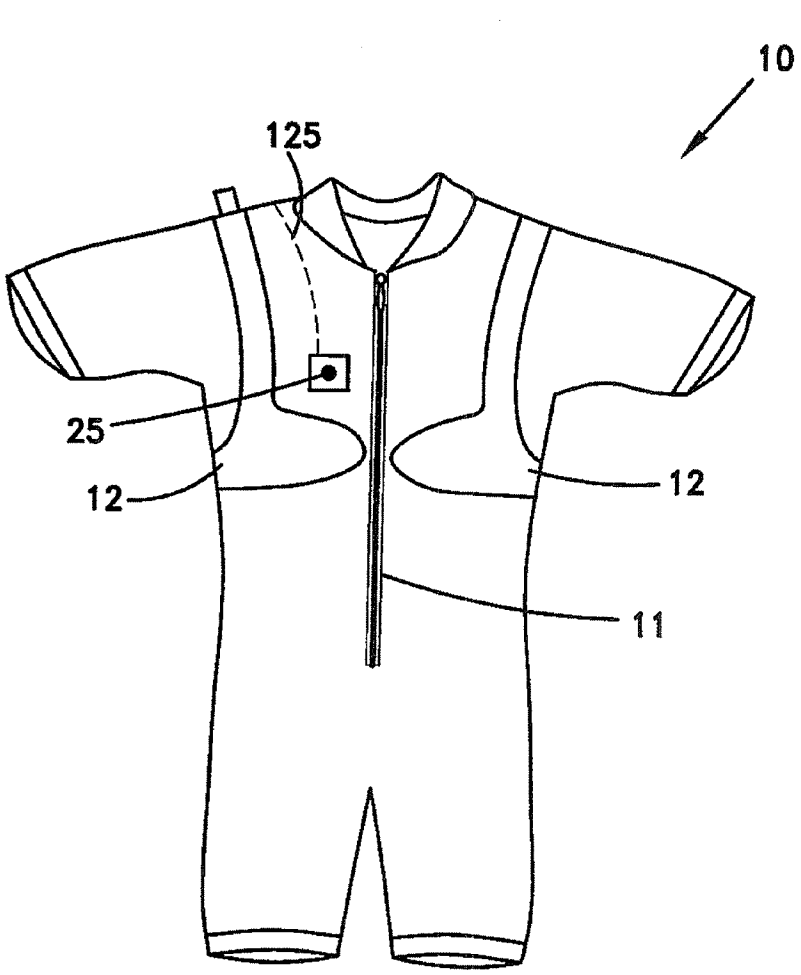
FIG. 2*a* is a front view of the inflatable life-saving swimming garment for children, according to a preferred embodiment of the present invention.

A preferred embodiment of the swimming garment of the present invention is shown in FIGS. 2*a* and 2*b* in front and rear views respectively, and is generally designated by reference numeral 10.

Figure 3:
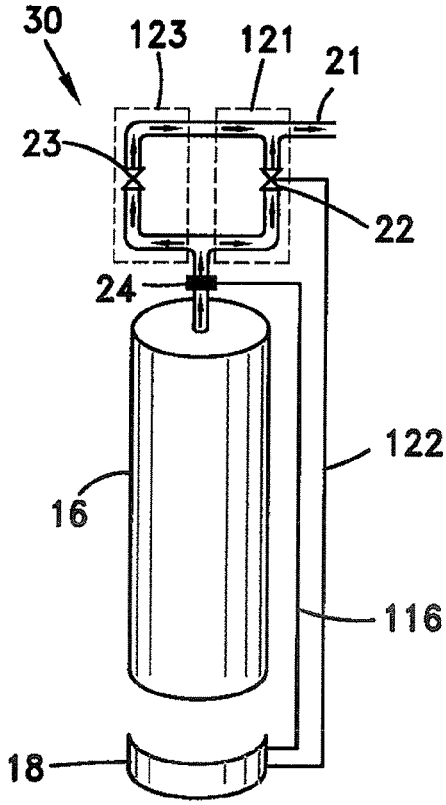
FIG. 3 is an illustration of the inflation system, according to a preferred embodiment of the present invention.

FIG. 2*a* illustrates a swimming garment 10 which comprises an inflatable part 12 around the shoulders part and around the waist part with a small gap for zipper 11 in front, and instant operating button loop 25. Instant operating button loop 25 is installed for cases in which the child who wears swimming garment 10 is in physical distress while swimming. Pulling the instant operating button loop 25 immediately inflates the swimming garment 10. Instant operating button loop 25 is attached to mechanically operated valve 23 by wire 125, as shown in FIGS. 2*a* and 2*b*. Mechanically operated valve 23 controls the air flow from air tank 16. Air tank 16 is connected to inflatable part 12 by an air pipe 21 that flows through path 123 as shown in FIG. 3. Pulling button loop 25 opens the mechanically operated valve 23 instantly, and the compressed air within air tank 16 expands into inflatable part 12 through path 123 and inflates it. Inflatable part 12 comprises inflatable back-part 112 at the lower back part of swimming garment 10 exploiting maximum inflatable regions. Inflatable back-part 112 and Inflatable part 12 inflates by the same air tank 16 and the same air pipe 21.

As illustrated in FIG. 3, inflation system 30 is an example of a possible arrangement. Inflation system 30 comprises controller 18 for controlling the swimming garment 10. Air tank 16 comprises compressed air for inflating inflatable part 12, air pipe 21 for conveying the air from air tank 16 to inflating inflatable part 12, electronically controlled valve 22 for keeping the compressed air within air tank 16, mechanically operated valve 23 for instantly operated cases, wiring 122 for conveying the commands from controller 18 toward the electronically controlled valve 22, air tank pressure sensor 24 for announcing about the air amount in air tank 16, and wiring 116 for conveying the data concerning air amount in air tank 16 to controller 18.

Figure 4:
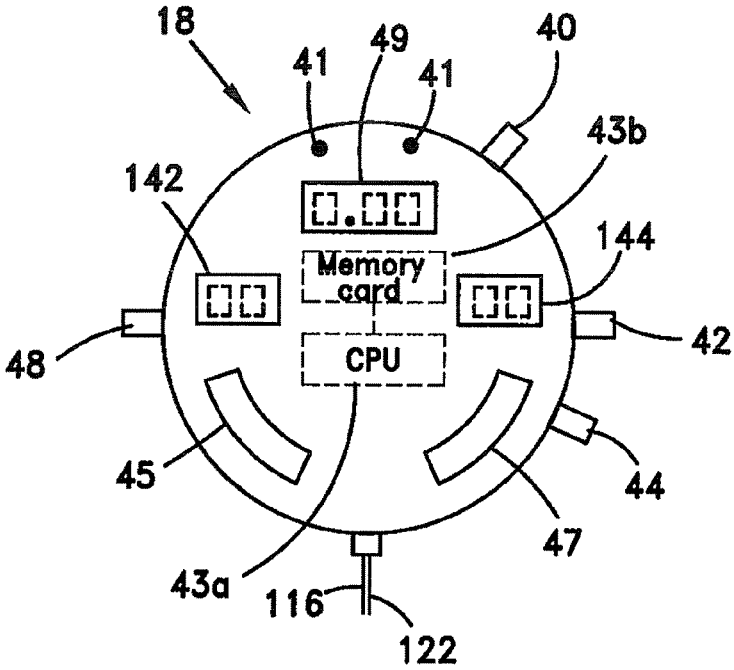
FIG. 4 is an illustration of a controller, according to a preferred embodiment of the present invention.

FIG. 4 illustrates the controller 18 for adjusting and controlling the swimming garment 10. Controller 18 comprises:

- electrical contacts 41 for operating the system, and for providing indication about saltwater or pool water;
- a digital-timer 142 and its related display for counting down the time for inflating the inflatable part 12;
- depth-meter 144 and its related display which displays the depth remains for starting digital-timer 142,
- a central processing unit (CPU) 43*a* for controlling inflatable system 30 and processing the received data;
- a memory card 43*b* for saving the inserted data;
- a current depth display 49 for displaying the current depth;
- a light button 40 for illuminating the controller 18 at night time;
- a digital-timer adjusting button 42 for adjusting the time threshold;
- a depth-meter adjusting button 44 for adjusting the depth threshold;
- a button 48 for inner test of inflatable system 30;
- a display 47 for the operability of inflatable system 30, including two green lights for undamaged inflatable system 30, and a red light (or vice versa);
- a battery for supplying electrical energy, not shown in the figure;
- a battery status display 45 for displaying the current status of the battery;
- a wiring 122 for electrically connecting the controller 18 to electronically operated valve 22;
- a wiring 116 for electrically connecting the controller 18 to air tank pressure sensor 24;

Electrical contacts 41 senses that the child is in aquatic environment with swimming garment 10. Electrical contacts 41 prevent the operation of inflatable system 30 out of the water. While staying in non-aquatic environment electrical contacts 41 enables CPU 43*a* to operate and to correlate between controller 18 components. In addition, controller 18 senses the resistance between electrical contacts 41. This resistance is analyzed by software within CPU 43*a*. This software is able to distinguish between pool water and saltwater and a suitable program will operate the swimming garment 10.

Before the child enters the water, a self test of inflation system 30 should be done by pressing self-test button 48. Pressing self-test button 48 sends an electrical signal which tests the intactness of controller 18 and inflation system 30 components. CPU 43*a* analyzes the data and outputs the test results by means of green light for intact system and red light for improper operation. The green/red light appears on display 47. After checking the operability of the system, the adjustment of the depth threshold and the threshold time is done by means of depth-meter adjusting button 44 and digital-timer adjusting button 42.

CPU 43*a* analyzes the time and depth adjustments, saves them in memory card 43*b* using the software installed in the CPU 43*a*, and displays them on display 142 and 144, respectively. In case when the depth shown in display 144 is zero, thus the depth is the depth threshold or deeper, CPU 43*a* receives a signal for starting digital timer 142. CPU 43*a* sends a signal to digital timer 142 which starts counting down the time threshold toward zero.

When the threshold time lapses CPU 43*a* processes it and sends a signal, through wiring 122, to electronically operated valve 22 to open. Consequently, air from air tank 16 flows into the inflatable part 12 through air pipe 21 and path 121 and inflates inflatable part 12.

All the electronic components introduced hereinabove are waterproofed by a suitable sealing material. This sealing material is attached to garment by any appropriate means such as gluing or sewing.

Swimming garment 10 should provide comfort feeling while wearing it either during swimming or outside the water, just the same as wearing a regular swimming suit. Swimming garment 10 is a re-usable apparatus, i.e. it can be used many times after it has been inflated. Therefore, it requires emptying the air of inflatable part 12 by opening valve 160, and afterwards to repeat the abovementioned process before re-using.

Figure 5:
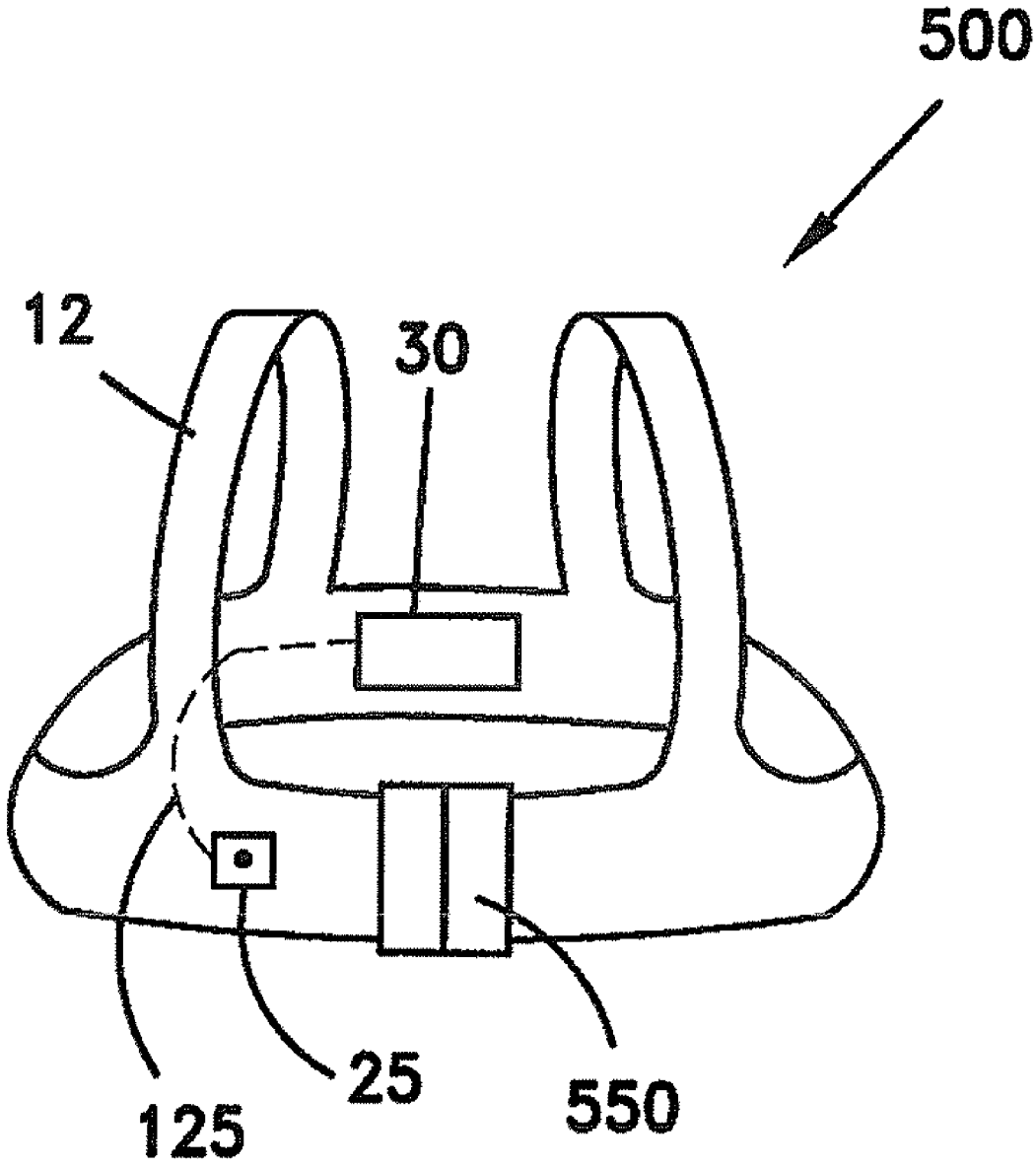
FIG. 5 is a schematic illustration of an inflatable life-saving swimming garment for children, according to another preferred embodiment of the present invention.

FIG. 5 is shows another preferred embodiment of the inflatable life-saving swimming garment 500, which is only an inflatable part 12 connected to inflation system 30. This inflatable part 12 can be worn on a naked or dressed child.

Inflatable life-saving swimming garment 500 comprises an inflatable part 12, a buckle 550 for fastening the inflatable life-saving swimming garment 500, and inflation system 30. Inflation system 30 operates as described hereinabove and comprises the same components. Inflating part 12 may consist of one or more inflatable parts in case one of them has been punctured. Each inflatable part is connected to the air tank by a corresponding valve.

Inflatable life-saving swimming garment 500 is also instantly operable manually by button loop 25, which is connected to the mechanically operated valve and inflatable part 12 within Inflation system 30 by means of wire 125.

Figure 6A:
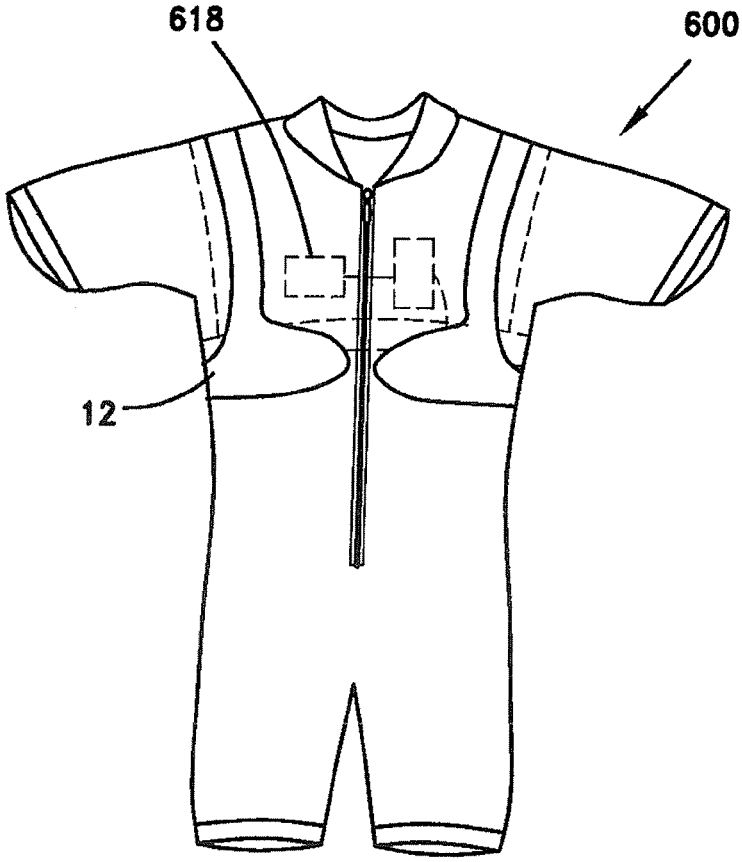
FIG. 6*a* is a schematic illustration of an inflatable life-saving swimming garment for toddlers, according to another preferred embodiment of the present invention.
Figure 6B:
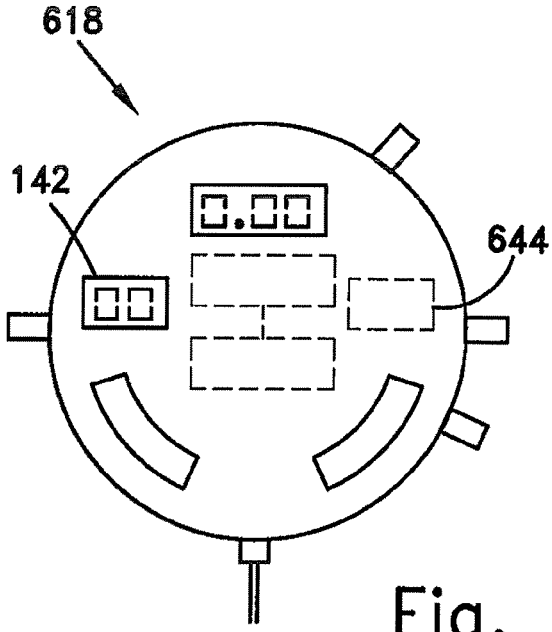
FIG. 6*b* is an illustration of a controller, according to another preferred embodiment of the present invention.

FIGS. 6*a* and 6*b* show an inflatable life-saving swimming garment 600 for toddlers and controller 618. These toddlers are not considered to be swimmers, since they can drown even in a bath without care of an adult. In addition, the steadiness of toddler either when sitting or standing is problematic. Thus, while the toddler enters the water his ability to stabilize himself becomes a difficult action. Consequently, the toddler may fall back or forward into the water easily, without the ability to help himself, unless an adult is in the area to take care of him.

Therefore, controller 618 herein is upgraded with an orientation sensor 644 instead of the depth-meter used hereinabove. The orientation sensor 644 senses the toddler's deviation from the vertical position, relatively to the water surface level.

In case the toddler is alone in water and falls forward or backward, the orientation sensor 644 sends two electrical signals, one for starting the digital-timer 142, the other to start a sound alert device (not shown). The digital-timer counts down the threshold time (in this case, a very short time) toward the zero while the sound alert device announces the caring adult about the emergency situation of the toddler. In any event, when the threshold time lapses, the inflatable part 12 inflates and floats the toddler up above the water surface level with his head directed upwardly.

Figure 7A:
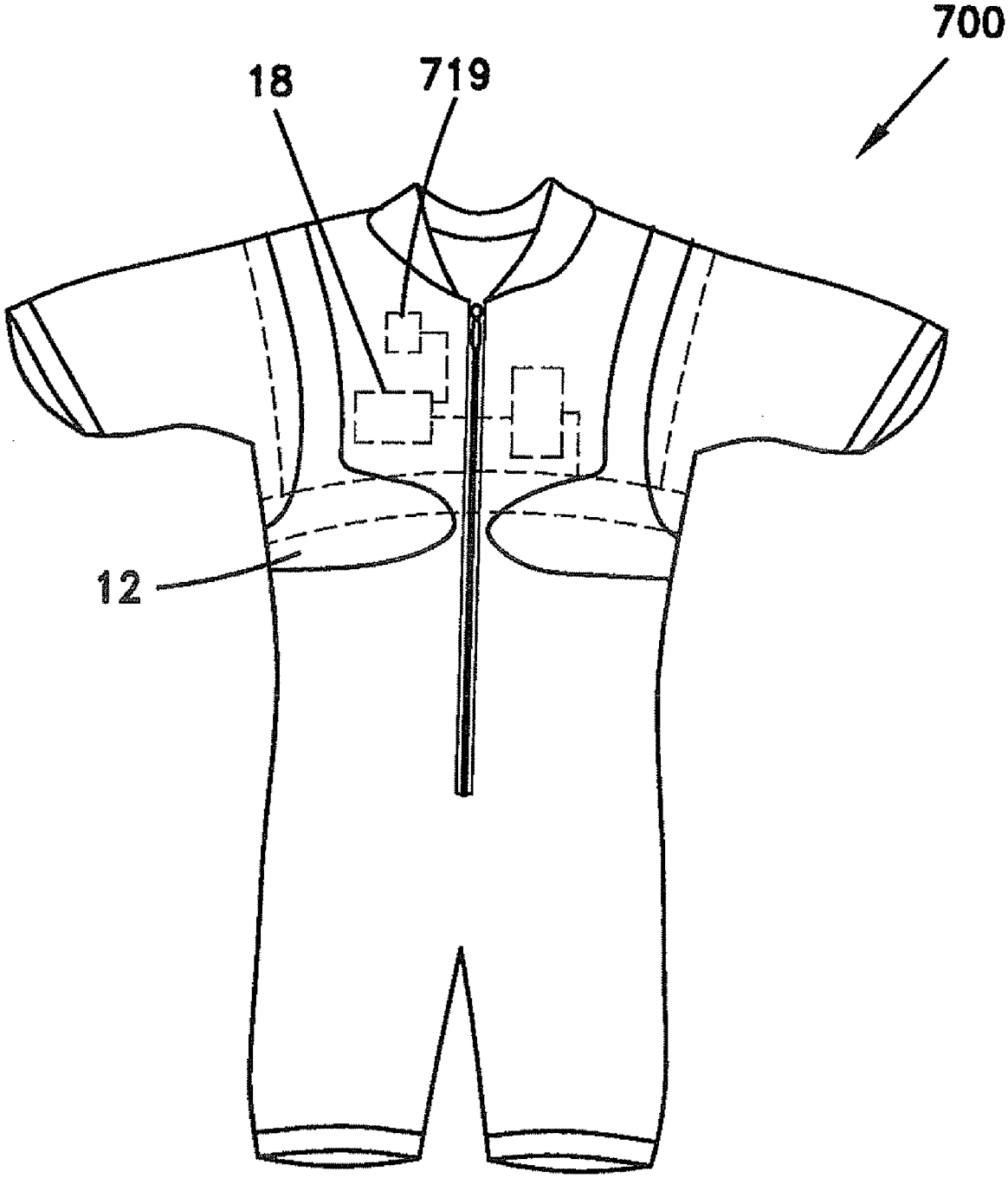
FIG. 7*a* is a schematic illustration of an inflatable life-saving swimming garment for children with a signaling system, according to another preferred embodiment of the present invention.
Figure 7B:
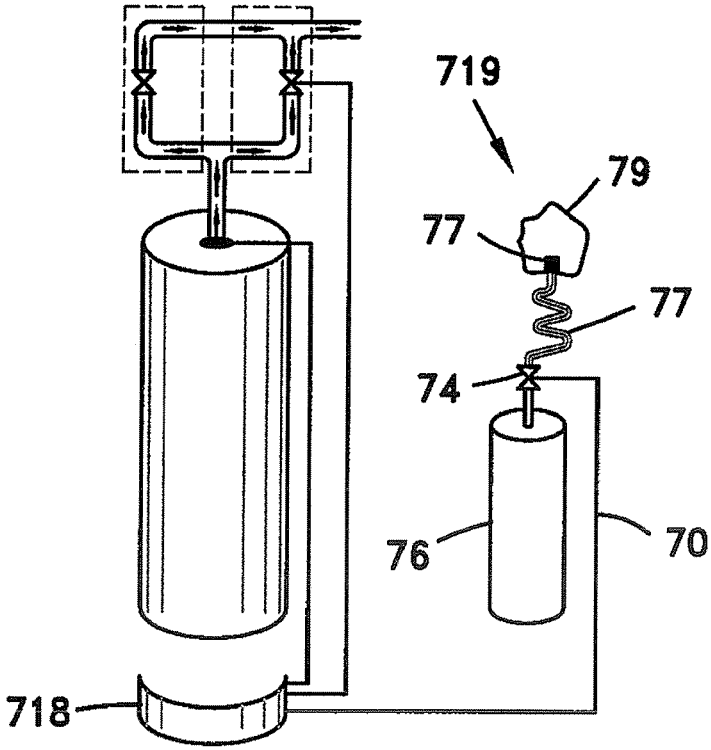
FIG. 7*b* is an illustration of the signaling system, according to a preferred embodiment of the present invention.
Figure 7C:
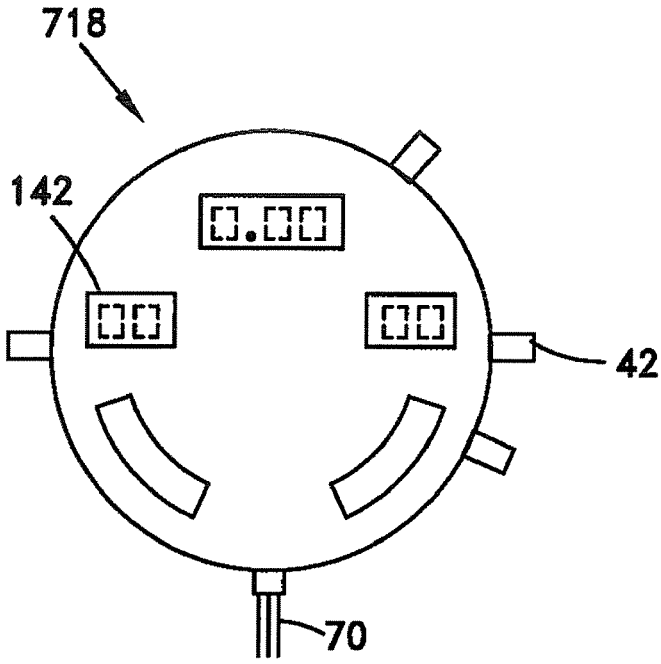
FIG. 7*c* is an illustration of the controller, according to another preferred embodiment of the present invention.

FIGS. 7*a*, 7*b* and 7*c* show another optional embodiment of inflatable life-saving swimming garment 700. This embodiment discloses signaling system 719 which inflates colored and lightened balloon that is emitted out of swimming garment 700 for signaling the distressed child in predefined time after sinking below the threshold depth.

Signaling system 719 comprises wiring 70 for connecting controller 18 to signaling system 719, a tank 76 with compressed lightweight gas (such as helium), electronically operated valve 74 for keeping the gas within the tank 76 in high pressure, predetermined length of rolled up pipe 78 that contains electrical wire within it, a miniature LED 77 and a colored balloon 79. Before the threshold time is adjusted, the timer in signaling system 719 is adjusted adjusting button 42 and saved in memory card 43*b*. After the predefined time lapses, an electronic signal is sent to electronically operated valve 74 to open.

Electronically operated valve 74 has been opened and the lightweight gas from tank 76 flows through rolled up pipe 78 to balloon 79 and inflate it. While the lightweight gas flows through the rolled up pipe 78, the compressed gas causes balloon 79 to inflate and simultaneously to jump out of the swimming garment 700. When electronically operated valve 74 received the electronic signal to open, electrical current flows through an inner electric wire located inside pipe 78 and lights LED 77. Consequently, the distressed child is signaled by a lightened and colored balloon which enables the lifeguard to save the child's life before the inflatable part 12 inflates and by that saving very important time. In case the lifeguard or any other adult has not noticed the distressed child, the inflatable part 12 will inflate after the predefined threshold time and will float the child up above the water surface level.

Another preferred embodiment of the inflatable life-saving swimming garment is the use of an orientation sensor for children in addition to the depth meter. The orientation sensor detects situations in which the child longitudinal body's axis is at predefined negative angle with respect to the water surface level (with his head directed in the opposite direction to the water surface level) and below it. In case the child is in a predefined negative angle and not at the threshold depth, a signal is sent to the digital-timer to start counting down the time toward the zero. Another case is when the child is at a predefined negative angle and also at the threshold depth, than the timer also gets a signal to start counting down. After the digital-timer has finished counting down, the inflation system 30 will work as already described.

Although embodiments of the invention have been described by way of illustration, it will be understood that the invention may be carried out with many variations, modifications, and adaptations, without departing from its spirit or exceeding the scope of the claims.

The invention claimed is:

1. An inflatable life-saving swimming garment for a swimmer, comprising:

an inflatable part for floating said swimmer while being in distress and for creating, when inflated, volume difference between an upper body part and a lower body part of said swimmer;

an inflating system that includes:

a gas tank with compressed gas for inflating, whenever required, said inflatable part;

a controllable valve connecting said air tank with said inflatable part, for allowing, whenever required, said compressed gas to inflate said inflatable part;

a controller for analyzing the swimmer's status underwater and opening said valve after said swimmer has been in an actual or impending distress for a predetermined time, wherein said controller comprises:

electrical contacts for providing indication regarding salt-water and pool water;

a depth-meter for measuring a present depth and a threshold depth;

a digital-timer for measuring the time for being at, or deeper than, said threshold depth;

an orientation sensor for sensing an angle deviation;

a central processing unit (CPU) for processing data that is inserted and received;

a memory card for saving data related to the swimmer;

a threshold depth-meter display for displaying the depth remaining before starting the digital timer;

a digital-timer display for displaying the time remaining before sending a signal to the electronically controlled valve to open;

a depth display for displaying current depth;

a light button for illuminating said controller whenever desired;

a digital-timer adjusting button for adjusting threshold time;

a depth-meter adjusting button for adjusting said threshold depth;

a self-test button for testing said inflating system;

a display for operability of said inflating system;

a battery for supplying electrical energy to said inflating system; and a battery status display for displaying current status of the battery; and a battery for supplying power for the operation of said controller and said valve.

2. An inflatable life-saving swimming garment according to claim 1, wherein said depth-meter is adjusted to threshold depth.

3. An inflatable life-saving swimming garment according to claim 2, wherein whenever the inflatable life-saving swimming garment is at, or deeper than, said threshold depth, said CPU sends a signal to said digital timer to start count down.

4. An inflatable life-saving swimming garment according to claim 3, wherein whenever the inflatable life-saving swimming garment is at the threshold depth and the threshold time lapses, the CPU sends a signal to the electronically controlled valve to open.

5. An inflatable life-saving swimming garment according to claim 1, wherein said digital timer is adjusted to threshold time.

6. An inflatable life-saving swimming garment according to claim 1, wherein said CPU comprises software for analyzing the data inserted and received from said inflation system.

7. An inflatable life-saving swimming garment according to claim 1, wherein the orientation sensor senses the deviation angle from the vertical, related to the water's surface level.

8. An inflatable life-saving swimming garment according to claim 1, wherein the orientation sensor senses a negative deviation angle.

9. An inflatable life-saving swimming garment for a swimmer, comprising:

an inflatable part for floating said swimmer while being in distress and for creating, when inflated, volume difference between an upper body part and a lower body part of said swimmer;

an inflating system that includes:

a gas tank with compressed gas for inflating, whenever required, said inflatable part;

a controllable valve connecting said air tank with said inflatable part, for allowing, whenever required, said compressed gas to inflate said inflatable part;

a controller for analyzing the swimmer's status underwater and opening said valve after said swimmer has been in an actual or impending distress for a predetermined time;

a battery for supplying power for the operation of said controller and said valve; and a signaling system, connected to said controller, to signal a swimmer in distress, wherein said signaling system comprises:

a balloon for signaling the swimmer;

a tank with compressed lightweight gas connected to said controller for inflating said balloon;

a pipe with a valve for connecting said gas tank to said balloon; and a light emitting diode within said balloon to emit light whenever required.

10. An inflatable life-saving swimming garment according to claim 9, wherein the pipe stretches to a predetermined length with the balloon in an end.

11. An inflatable life-saving swimming garment according to claim 9, wherein the pipe contains inside an electrical wire for conveying power to the LED.

12. An inflatable life-saving swimming garment according to claim 9, wherein said valve is an electronically controlled valve.

* * * * *